US009353598B2

(12) United States Patent
Naedler et al.

(10) Patent No.: US 9,353,598 B2
(45) Date of Patent: May 31, 2016

(54) SEAT ASSEMBLY WITH COUNTER FOR ISOLATING FRACTURE ZONES IN A WELL

(71) Applicant: UTEX Industries, Inc., Houston, TX (US)

(72) Inventors: Mark Henry Naedler, Cypress, TX (US); Derek L. Carter, Houston, TX (US)

(73) Assignee: UTEX Industries, Inc., Houston, TX (US)

( * ) Notice: Subject to any disclaimer, the term of this patent is extended or adjusted under 35 U.S.C. 154(b) by 348 days.

(21) Appl. No.: 13/887,779

(22) Filed: May 6, 2013

(65) Prior Publication Data

US 2013/0299199 A1 Nov. 14, 2013

Related U.S. Application Data

(60) Provisional application No. 61/644,887, filed on May 9, 2012.

(51) Int. Cl.

| | |
|---|---|
| ***E21B 34/14*** | (2006.01) |
| ***E21B 43/14*** | (2006.01) |
| *E21B 34/00* | (2006.01) |

(52) U.S. Cl.

CPC ..... *E21B 34/14* (2013.01); *E21B 43/14* (2013.01); *E21B 2034/007* (2013.01)

(58) Field of Classification Search

CPC .... E21B 34/14; E21B 43/14; E21B 2034/007
See application file for complete search history.

(56) References Cited

U.S. PATENT DOCUMENTS

| | | | | |
|---|---|---|---|---|
| 2,947,363 | A | 8/1960 | Sackett et al. | |
| 2,973,006 | A | 2/1961 | Nelson | |
| 3,054,415 | A * | 9/1962 | Baker | E21B 34/14 137/625.38 |

(Continued)

FOREIGN PATENT DOCUMENTS

| | | |
|---|---|---|
| EP | 2791458 | 10/2014 |
| JP | 2006314708 | 11/2006 |

(Continued)

OTHER PUBLICATIONS

Dictionary definition of "elastomer", accessed via thefreedictionary.com.*

(Continued)

*Primary Examiner* — Blake Michener
(74) *Attorney, Agent, or Firm* — Haynes and Boone, LLP

(57) ABSTRACT

A specially designed rotary indexing system and associated operational methods are incorporated in a downhole control device, representatively a sliding sleeve valve, having an outer tubular member in which an annular plug seat is coaxially disposed. The plug seat is resiliently expandable between a first diameter and a larger second diameter and is illustratively of a circumferentially segmented construction. The rotary indexing system is operative to detect the number of plug members that pass through and diametrically expand the plug seat, and responsively preclude passage of further plug members therethrough when such number reaches a predetermined magnitude. Such predetermined magnitude is correlated to the total rotation of an indexing system counter ring portion rotationally driven by axial camming forces transmitted to the rotary indexing system by successive plug member passage-generated diametrical expansions of the plug seat.

24 Claims, 12 Drawing Sheets

(56) References Cited

U.S. PATENT DOCUMENTS 3,441,279 A 4/1969 Lally et al.
3,554,281 A * 1/1971 Ecuer ..... E21B 43/14 166/155
3,568,768 A 3/1971 Rowell, Jr.
3,667,505 A 6/1972 Radig
3,885,627 A 5/1975 Berry et al.
4,044,835 A * 8/1977 Mott ..... E21B 34/105 166/322
4,189,150 A 2/1980 Langieri
4,252,196 A 2/1981 Silberman et al.
4,292,988 A 10/1981 Montgomery
4,448,216 A 5/1984 Speegle et al.
4,510,994 A * 4/1985 Pringle ..... E21B 34/14 166/156
4,520,870 A * 6/1985 Pringle ..... E21B 34/14 166/239
4,537,383 A 8/1985 Fredd
4,583,593 A 4/1986 Zunkel et al.
4,828,037 A 5/1989 Lindsey et al.
5,146,992 A 9/1992 Baugh
5,226,539 A 7/1993 Cheng
5,244,044 A 9/1993 Henderson
5,297,580 A 3/1994 Thurman
5,813,483 A 9/1998 Latham et al.
5,960,881 A 10/1999 Allamon et al.
6,003,607 A 12/1999 Hagen et al.
6,032,734 A 3/2000 Telfer
6,053,246 A 4/2000 Echols et al.
6,053,250 A * 4/2000 Echols ..... E21B 17/06 166/242.7
6,155,350 A 12/2000 Melenyzer
6,227,298 B1 5/2001 Patel
6,230,807 B1 5/2001 Patel
6,390,200 B1 5/2002 Allamon et al.
6,662,877 B2 12/2003 Patel
6,681,860 B1 1/2004 Yokley et al.
6,695,066 B2 2/2004 Allamon et al.
6,725,935 B2 4/2004 Szarka et al.
6,769,490 B2 8/2004 Allamon et al.
6,799,638 B2 10/2004 Butterfield, Jr.
6,866,100 B2 3/2005 Gudmestad et al.
6,966,368 B2 11/2005 Farquhar
7,021,389 B2 4/2006 Bishop et al.
7,503,392 B2 3/2009 King et al.
7,637,323 B2 12/2009 Schasteen et al.
7,644,772 B2 * 1/2010 Avant ..... E21B 34/14 166/318
7,673,677 B2 3/2010 King et al.
7,921,922 B2 4/2011 Darnell et al.
8,151,891 B1 4/2012 Darnell et al.
8,261,761 B2 9/2012 Gerrard et al.
8,276,675 B2 * 10/2012 Williamson ..... E21B 21/103 166/306
8,403,068 B2 3/2013 Robison et al.
8,479,808 B2 * 7/2013 Gouthaman ..... E21B 33/1285 166/156
8,479,823 B2 7/2013 Mireles
8,668,006 B2 * 3/2014 Xu ..... E21B 34/14 166/192
8,950,496 B2 2/2015 Kitzman
9,004,179 B2 4/2015 Chauffe
2002/0043368 A1 * 4/2002 Bell ..... E21B 33/1216 166/118
2005/0072572 A1 4/2005 Churchill
2006/0213670 A1 9/2006 Bishop et al.
2006/0243455 A1 11/2006 Telfer et al.
2007/0017679 A1 * 1/2007 Wolf ..... E21B 23/006 166/312
2007/0181188 A1 8/2007 Branch et al.
2008/0093080 A1 4/2008 Palmer et al.
2008/0217025 A1 9/2008 Ruddock et al.
2009/0044946 A1 2/2009 Schasteen et al.
2009/0044949 A1 2/2009 King et al.
2009/0044955 A1 2/2009 King et al.
2009/0308588 A1 * 12/2009 Howell ..... E21B 21/103 166/66.4
2010/0132954 A1 6/2010 Telfer
2010/0212911 A1 * 8/2010 Chen ..... E21B 23/04 166/373
2010/0282338 A1 * 11/2010 Gerrard ..... E21B 33/1208 137/330
2011/0067888 A1 3/2011 Mireless
2011/0108284 A1 * 5/2011 Flores ..... E21B 34/14 166/373
2011/0180270 A1 7/2011 Martin et al.
2011/0192613 A1 * 8/2011 Garcia ..... E21B 23/08 166/373
2011/0278017 A1 * 11/2011 Themig ..... E21B 34/14 166/373
2011/0315389 A1 * 12/2011 Crider ..... E21B 34/14 166/329
2011/0315390 A1 * 12/2011 Guillory ..... E21B 21/103 166/329
2012/0048556 A1 3/2012 O'Connell et al.
2012/0097265 A1 4/2012 Gerrard et al.
2012/0227973 A1 * 9/2012 Hart ..... E21B 21/103 166/329
2012/0261131 A1 10/2012 Hofman et al.
2012/0305236 A1 * 12/2012 Gouthaman ..... E21B 33/1285 166/118
2012/0305265 A1 * 12/2012 Garcia ..... E21B 34/063 166/373
2013/0025868 A1 * 1/2013 Smith ..... E21B 21/103 166/308.1
2013/0118732 A1 * 5/2013 Chauffe ..... E21B 34/06 166/250.04
2013/0133876 A1 * 5/2013 Naedler ..... E21B 43/16 166/101
2013/0153220 A1 * 6/2013 Carter ..... E21B 33/128 166/285
2013/0186633 A1 * 7/2013 Kitzman ..... E21B 23/04 166/318
2013/0186644 A1 7/2013 Smith et al.
2014/0060813 A1 * 3/2014 Naedler ..... E21B 34/06 166/135
2015/0176361 A1 * 6/2015 Prosser ..... E21B 34/14 166/192

FOREIGN PATENT DOCUMENTS

WO WO 00/63526 A1 10/2000
WO WO 2009/067485 A2 5/2009
WO WO 2013/090805 6/2013

OTHER PUBLICATIONS

PCT Search Report with Written Opinion, Application No. PCT/US2013/039964, Sep. 4, 2013, 14 pgs.
Supplementary European Search Report and Annex to the European Search Report issued for EP13787954, dated Sep. 17, 2015, 6 pgs.

* cited by examiner

SEAT ASSEMBLY WITH COUNTER FOR ISOLATING FRACTURE ZONES IN A WELL

CROSS-REFERENCE TO RELATED APPLICATION

The present application claims the benefit of the filing date of provisional U.S. patent application No. 61/644,887 filed May 9, 2012. The entire disclosure of the provisional application is hereby incorporated herein by this reference.

FIELD OF THE INVENTION

The present invention relates to a fracture plug seat assembly used in well stimulation for engaging and creating a seal when a plug, such as a ball, is dropped into a wellbore and landed on the fracture plug seat assembly for isolating fracture zones in a well. More particularly, the present invention relates to a fracture plug seat assembly that includes a mechanical counter allowing plugs to pass through the seat then locking to a rigid seat position after a designated number of plugs from the surface have passed through the seat. The locking mechanism disengages when flow is reversed and plugs are purged.

BACKGROUND

In well stimulation, the ability to perforate multiple zones in a single well and then fracture each zone independently, referred to as "zone fracturing", has increased access to potential reserves. Zone fracturing helps stimulate the well by creating conduits from the formation for the hydrocarbons to reach the well. Many gas wells are drilled for zone fracturing with a system called a ball drop system planned at the well's inception. A well with a ball drop system will be equipped with a string of piping below the cemented casing portion of the well. The string is segmented with packing elements, fracture plugs and fracture plug seat assemblies to isolate zones. A fracture plug, such as a ball or other suitably shaped structure (hereinafter referred to collectively as a "ball") is dropped or pumped down the well and seats on the fracture plug seat assembly, thereby isolating pressure from above.

Typically, in ball drop systems a fracture plug seat assembly includes a fracture plug seat having an axial opening of a select diameter. To the extent multiple fracture plugs are disposed along a string, the diameter of the axial opening of the respective fracture plug seats becomes progressively smaller with the depth of the string. This permits a plurality of balls having a progressively increasing diameter, to be dropped (or pumped), smallest to largest diameter, down the well to isolate the various zones, starting from the toe of the well and moving up.

A large orifice through an open seat is desired while fracing zones below that seat. An unwanted consequence of having seats incrementally smaller as they approach the toe is the existence of pressure loss across the smaller seats. The pressure loss reduces the efficiency of the system and creates flow restrictions while fracing and during well production.

In order to maximize the number of zones and therefore the efficiency of the well, the difference in the diameter of the axial opening of adjacent fracture plug seats and the diameter of the balls designed to be caught by such fracture plug seats is very small, and the consequent surface area of contact between the ball and its seat is very small. Due to the high pressure that impacts the balls during a hydraulic fracturing process, the balls often become stuck and are difficult to purge when fracing is complete and the well pressure reverses the flow and produces to the surface. If a ball is stuck in the seat and cannot be purged, the ball(s) must be removed from the string by costly and time-consuming milling or drilling processes.

FIG. 1 illustrates a prior art fracture plug seat assembly 10 disposed along a tubing string 12. Fracture plug seat assembly 10 includes a metallic, high strength composite or other rigid material seat 14 mounted on a sliding sleeve 16 which is movable between a first position and a second position. In the first position shown in FIG. 1, sleeve 16 is disposed to inhibit fluid flow through radial ports 18 from annulus 20 into the interior of tubing string 12. Packing element 24 is disposed along tubing string 12 to restrict fluid flow in the annulus 20 formed between the earth 26 and the tubing string 12.

FIG. 2 illustrates the prior art fracture plug seat assembly 10 of FIG. 1, but with a ball 28 landed on the metallic, high strength composite or other rigid material seat 14 and with sliding sleeve 16 in the second position. With ball 28 landed on the metallic, high strength composite or other rigid material seat 14, fluid pressure 30 applied from uphole of fracture plug seat assembly 10 urges sliding sleeve 16 into the second position shown in FIG. 2, thereby exposing radial ports 18 to permit fluid flow therethrough, diverting the flow to the annulus 20 formed between the earth 26 and the tubing string 12.

As shown in FIGS. 1 and 2, the metallic, high strength composite or other rigid material seat 14 has a tapered surface 32 that forms an inverted cone for the ball or fracture plug 28 to land upon. This helps translate the load on the ball 28 from shear into compression, thereby deforming the ball 28 into the metallic, high strength composite or other rigid material seat 14 to form a seal. In some instances, the surface of such metallic, high strength composite or other rigid material seats 14 have been contoured to match the shape of the ball or fracture plug 28. One drawback of such metallic, high strength composite or other rigid material seats 14 is that high stress concentrations in the seat 14 are transmitted to the ball or fracture plug 28. For various reasons, including specific gravity and ease of milling, balls or fracture plugs 28 are often made of a composite plastic or aluminum. Also, efforts to maximize the number of zones in a well has reduced the safety margin of ball or fracture plug failure to a point where balls or fracture plugs can extrude, shear or crack under the high pressure applied to the ball or fracture plug during hydraulic fracturing operations. As noted above, when the balls 28 extrude into the metallic, high strength composite or other rigid material seat 14 they become stuck. In such instances, the back pressure from within the well below is typically insufficient to purge the ball 28 from the seat 14, which means that an expensive and time-consuming milling process must be conducted to remove the ball 28 from the seat 14.

Other prior art fracture plug seat assembly designs include mechanisms that are actuated by sliding pistons and introduce an inward pivoting mechanical support beneath the ball. These designs also have a metallic, high strength composite or other rigid material seat, but are provided with additional support from the support mechanism. These fracture plug seat assembly designs can be described as having a normally open seat that closes when a ball or fracture plug is landed upon the seat. Such normally open fracture plug seat assembly designs suffer when contaminated with the heavy presence of sand and cement. They also rely upon incrementally sized balls so such systems suffer from flow restriction and require post frac milling.

DETAILED DESCRIPTION

The method and apparatus of the present invention provides a fracture plug seat assembly used in well stimulation for engaging and creating a seal when a plug, such as a ball, is dropped into a wellbore and landed on the fracture plug seat assembly for isolating fracture zones in a well. The fracture plug seat assembly has a fracture plug seat that includes an expandable ring that enables the seat to expand when a ball passes through and actuates a counting mechanism so that balls are allowed to pass until the counting mechanism reaches a predetermined position which will enable the actuation of a locking mechanism. When actuated, the locking mechanism prevents expansion of the seat when the next ball lands on the seat and pressure is applied from the upstream direction. When flow is reversed, the seat is free to disengage from the locking mechanism and allow expansion and hence, balls that had previously passed through the seat pass through from downstream and return to the surface.

According to the fracture plug seat assembly of the present invention, all balls have the same size and, therefore, flow restriction is greatly reduced at the lower zones, since the seat orifices do not become incrementally smaller. Also, according to the fracture plug seat assembly of the present invention, when dropping balls from the surface, it is not required to drop sequential ball sizes which eliminates a potential source of errors. Moreover, only one size of seat assembly and ball must be manufactured, instead of sometimes 40 different sizes, making manufacturing more cost effective. Finally, according to the fracture plug seat assembly of the present invention, the resulting production flow from the string can eliminate the need to mill out the seats.

Figure 1:
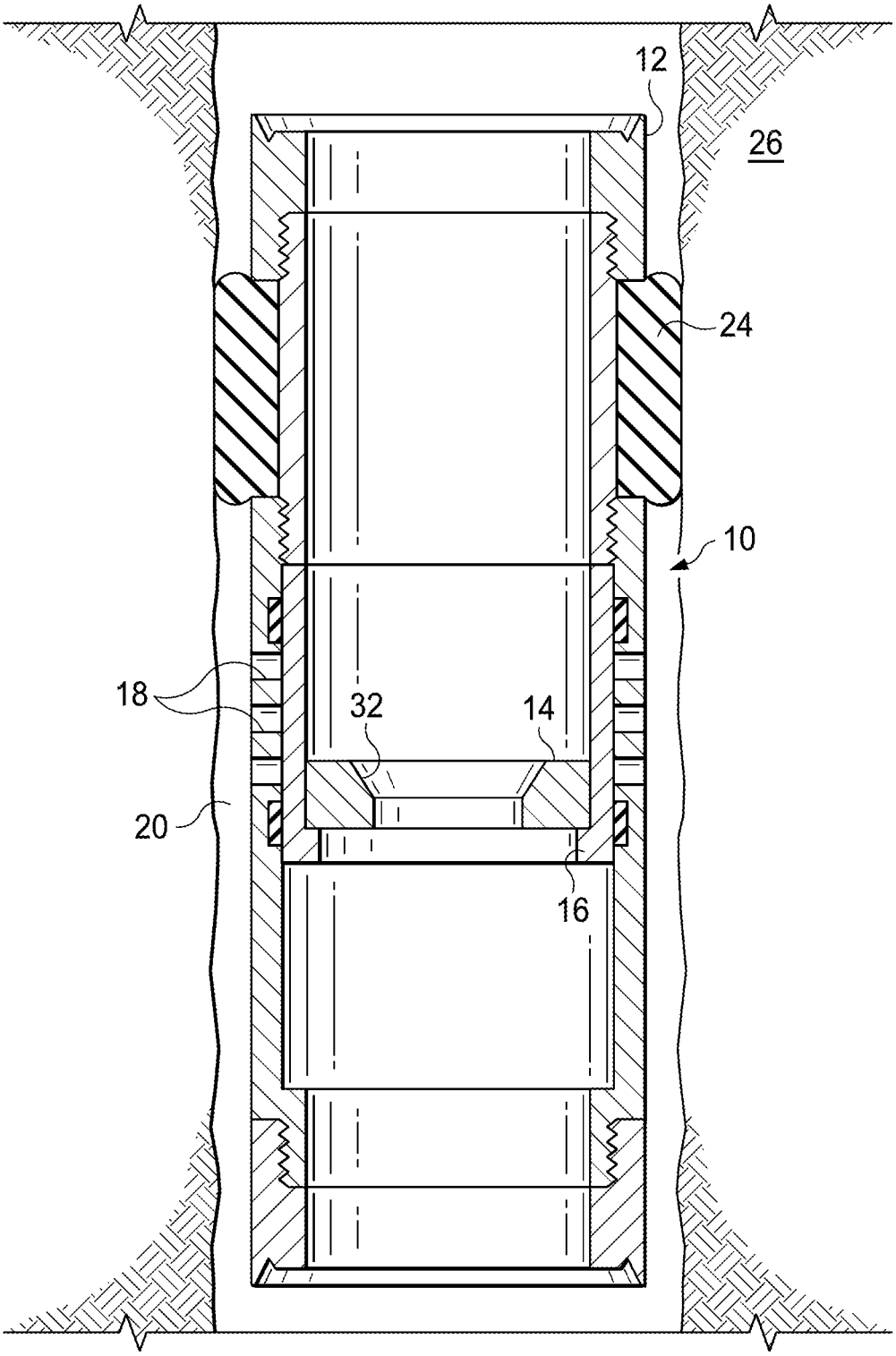
FIG. 1 illustrates a prior art fracture plug seat assembly positioned in a well bore.
Figure 2:
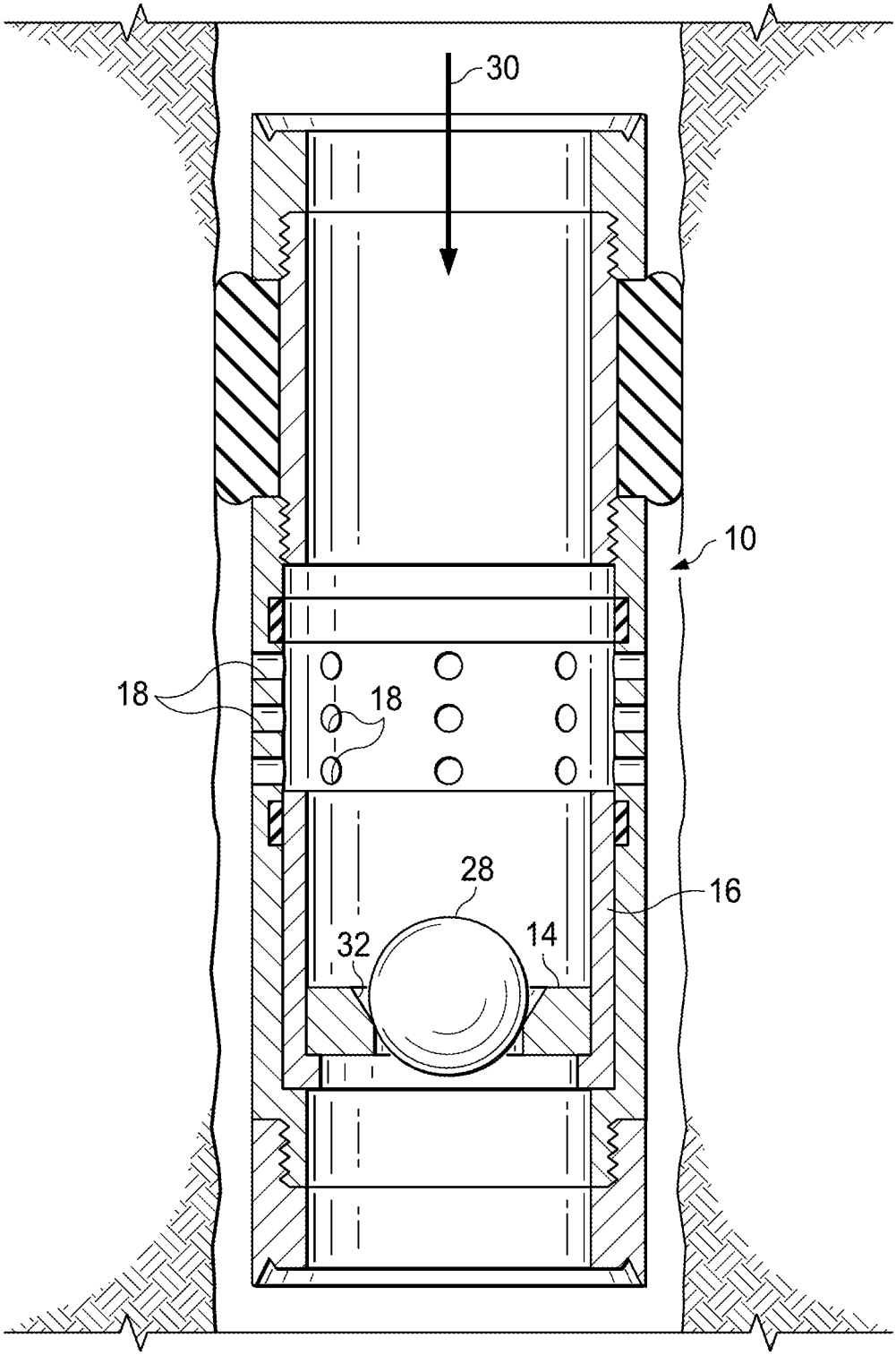
FIG. 2 illustrates the prior art fracture plug seat assembly of FIG. 1 with a ball landed on the seat of the fracture plug seat assembly.
Figure 3:
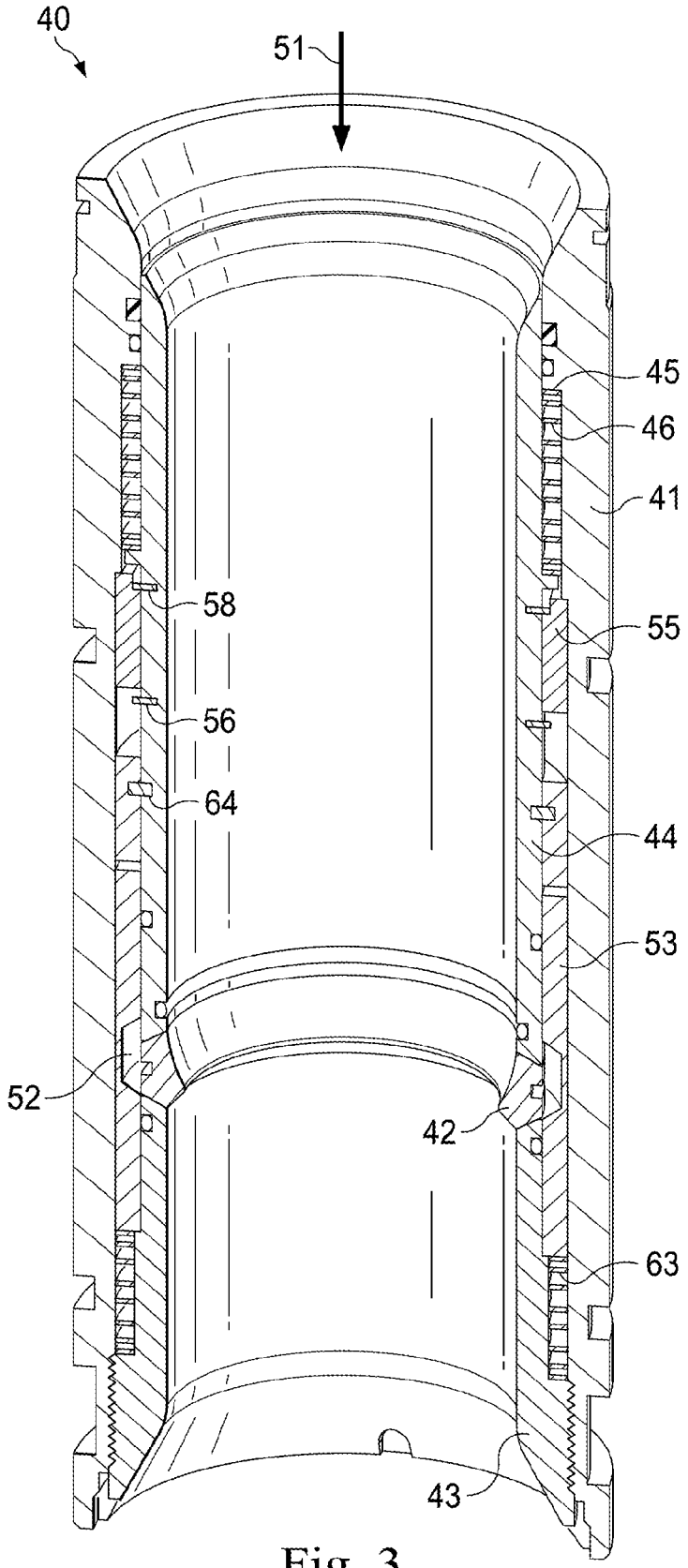
FIG. 3 illustrates a cross-section of a fracture plug seat assembly incorporating an embodiment of the present invention with a cam driven rotating counter in the unlocked position.

FIG. 3 illustrates a cross-section of a fracture plug seat assembly incorporating an embodiment of the present invention. Specifically, sliding sleeve assembly 40 is illustrated in a position to receive balls which will pass through and be counted. Sliding sleeve 41 is sealably retained within a tubing string. A segmented expandable seat assembly 42 is in a first closed position and positioned between a lower seat nut 43 and an upper piston 44. The lower seat nut 43 is threadably connected to and does not move relative to the sliding sleeve 41. The upper piston 44 is biased in the downstream direction 51 against the seat assembly 42 by a spring 46. The spring 46 engages a shoulder 45 on the sliding sleeve 41.

Figure 4:
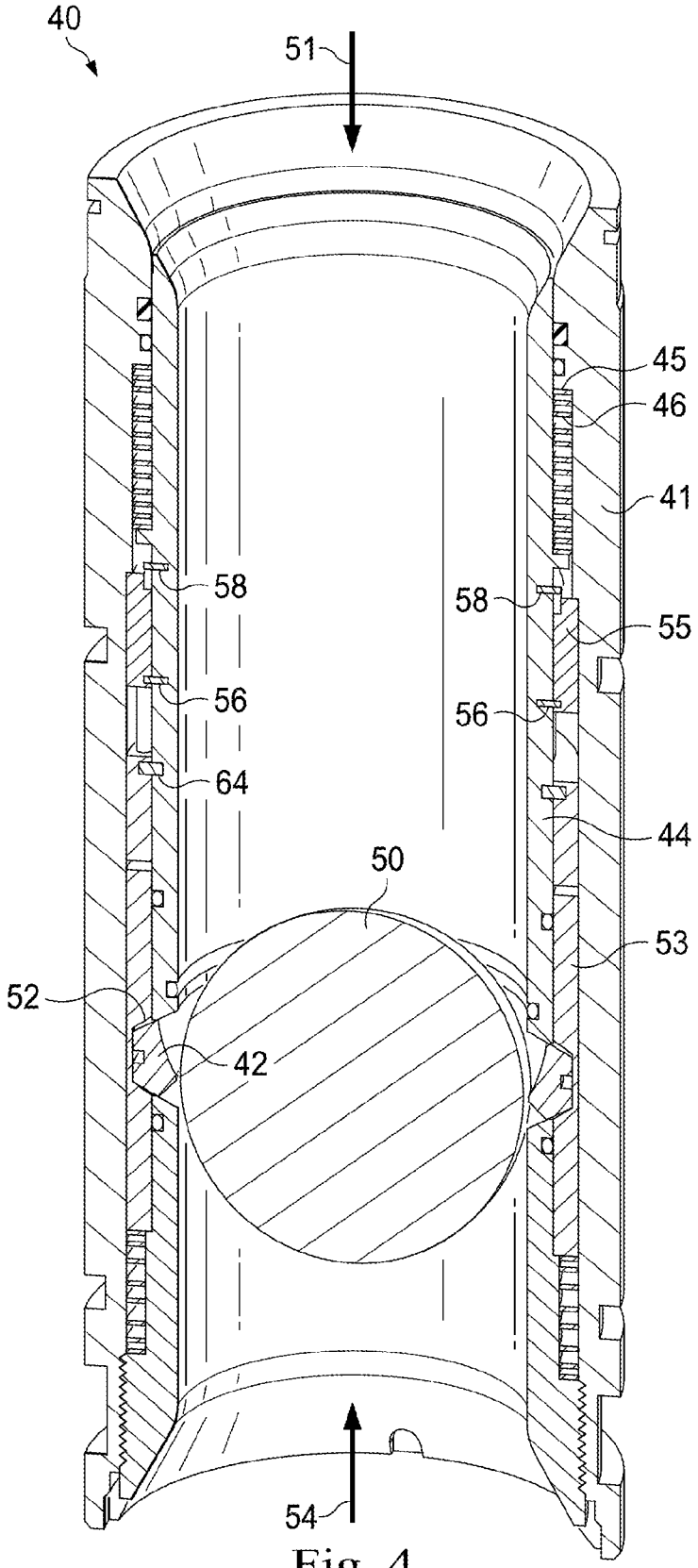
FIG. 4 illustrates a cross-section of the fracture plug seat assembly illustrated in FIG. 3 with a ball passing through the assembly and actuating an expandable seat.
Figure 5:
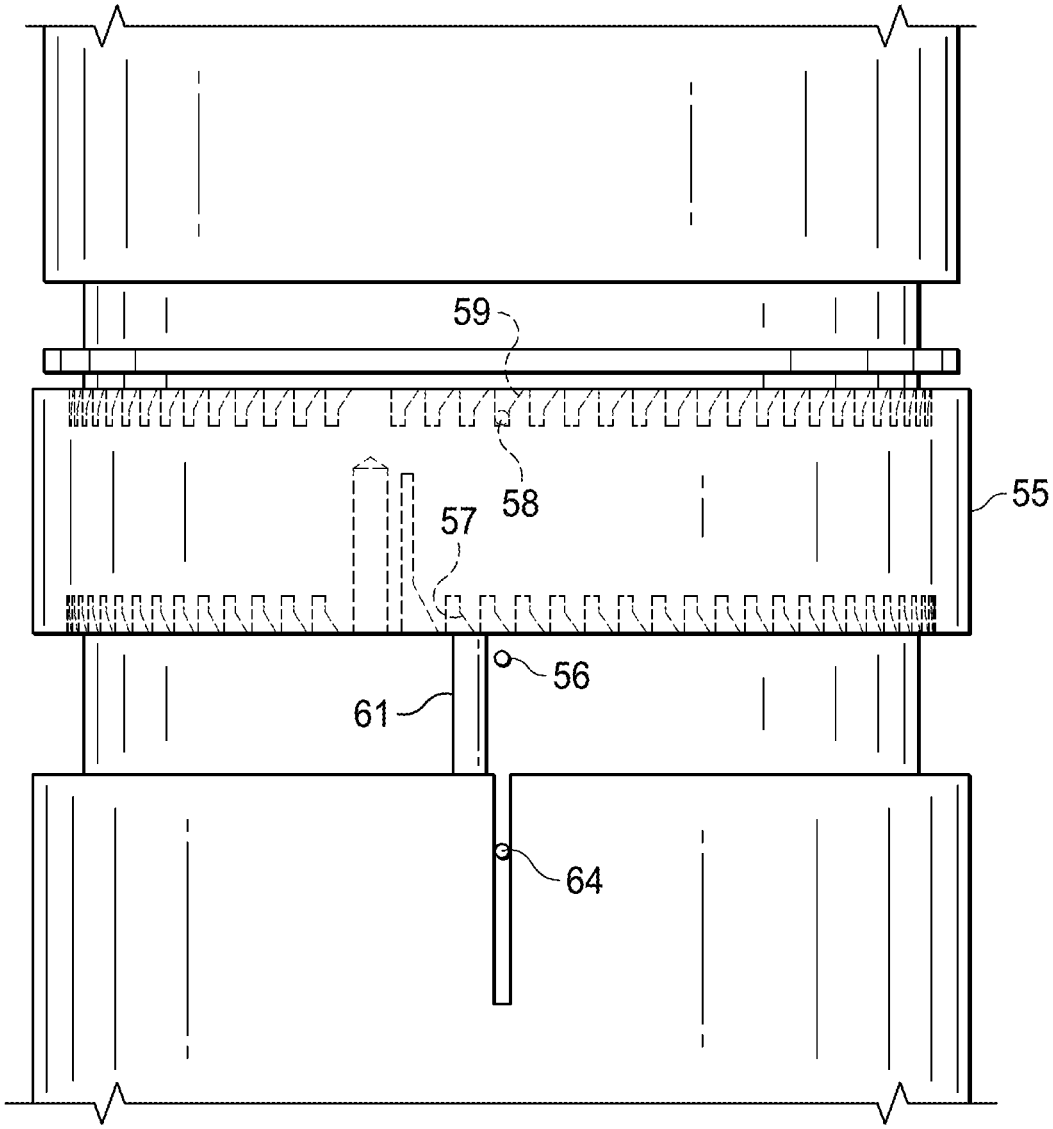
FIG. 5 illustrates a side view of an embodiment of a counting mechanism of the present invention for use in a fracture plug seat assembly with a semi-translucent counting ring.
Figure 7:
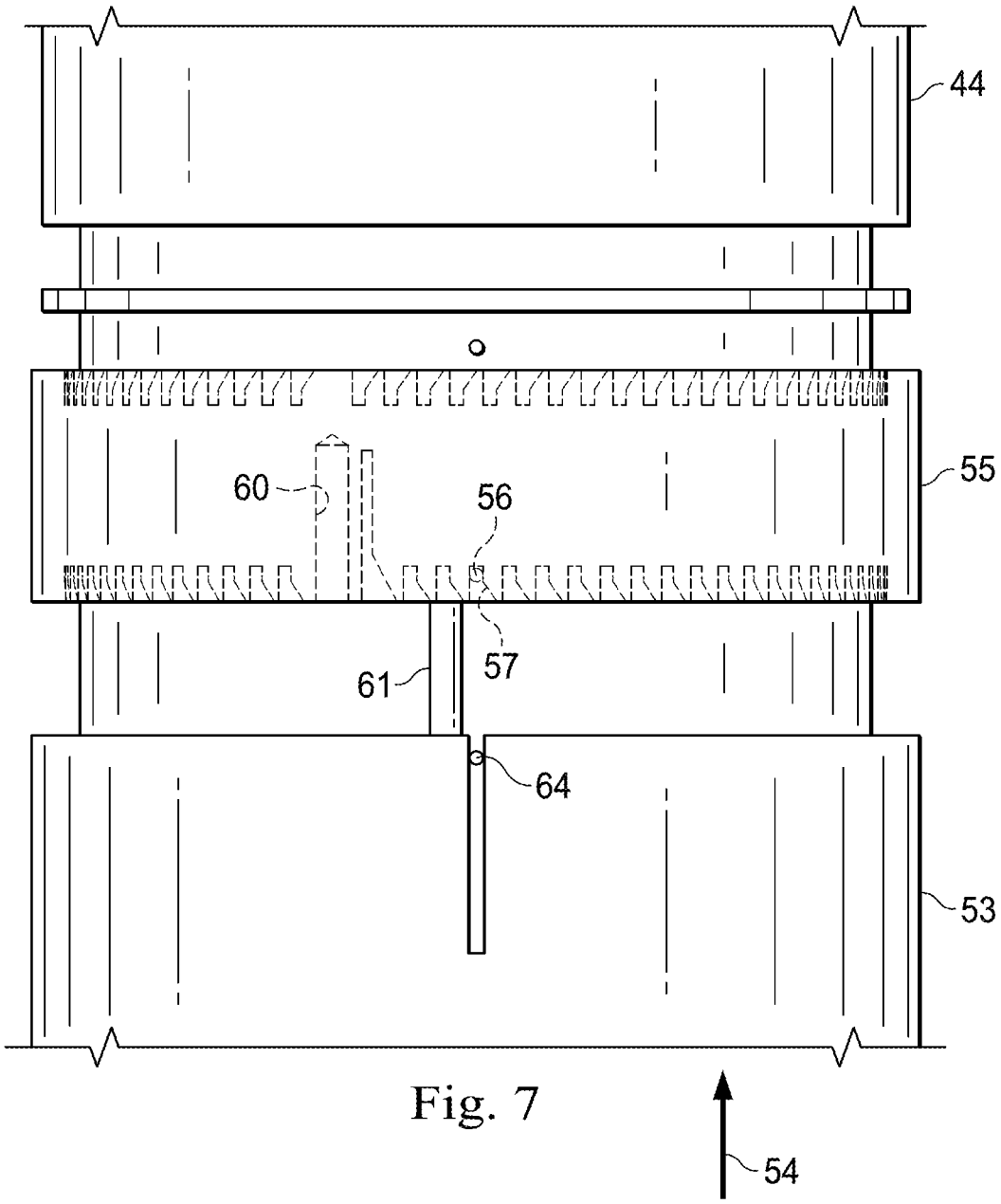
FIG. 7 illustrates a side view of the embodiment of a counting mechanism of the present invention illustrated in FIG. 5 with the components in position to actuate the counter.

FIG. 4 illustrates the fracture plug seat assembly of FIG. 3 with a ball 50 passing through the sliding sleeve assembly 40 in the direction 51 with the direction of flow moving upstream to downstream. In FIG. 4, the ball 50 is engaged with the expandable seat assembly 42 and has driven the seat radially outward into a pocket 52 of a locking ring 53. The upper piston 44 is wedged to move in the upstream direction 54 and further compresses the spring 46. When the upper piston 44 moves in the upstream direction 54 it actuates a counting ring 55 via radial pins 56 which are rigidly connected to the upper piston 44 by engaging a cam surface 57 located on the end of the counting ring 55. FIG. 5 illustrates an embodiment for actuating the counting ring 55. As the radial pins 56 move axially in the upstream direction 54 and into the counting ring 55, the counting ring 55, which is shouldered axially to the sliding sleeve 41 is forced to rotate as the radial pins 56 slide along the cam surface 57. When the ball 50 has passed through the expandable seat assembly 42, the spring 46 forces the upper piston 44 to return to the position shown in FIG. 3. According to the counting mechanism embodiment illustrated in FIG. 5, a second set of radial pins 58 engages a cam surface 59 on the upstream end of the counting ring 55 and force further rotation of the counting ring 55 by sliding across the cam surface 59. As shown in FIG. 7, axial pin(s) 61 prevent the counting ring 55 from moving in the downstream direction since they are rigidly connected to the locking ring 53 which is biased in the upstream direction 54 by spring 63 (FIG. 3).

Figure 6:
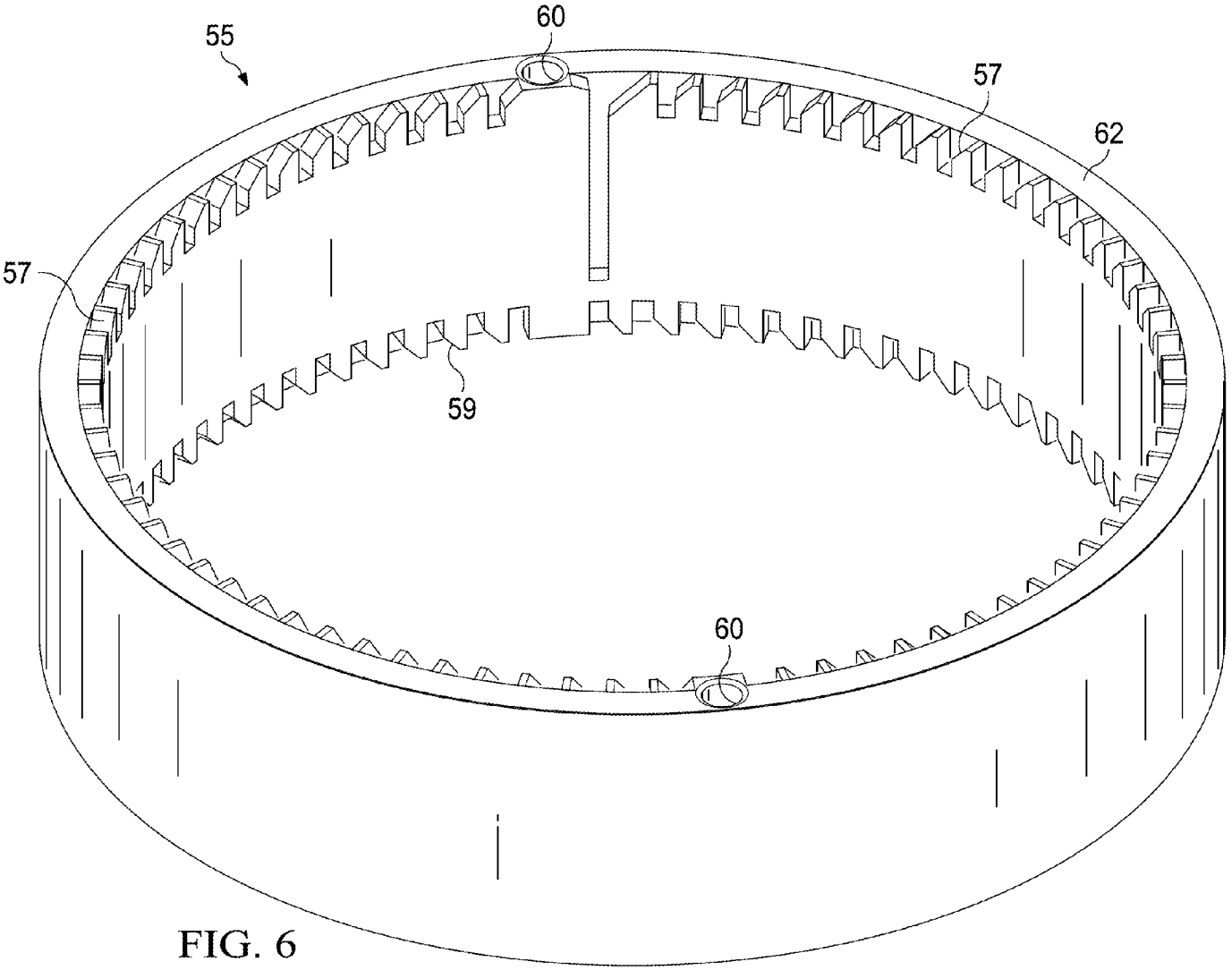
FIG. 6 illustrates an isometric view of an embodiment of a counting ring of the present invention for use in a fracture plug seat assembly.
Figure 8:
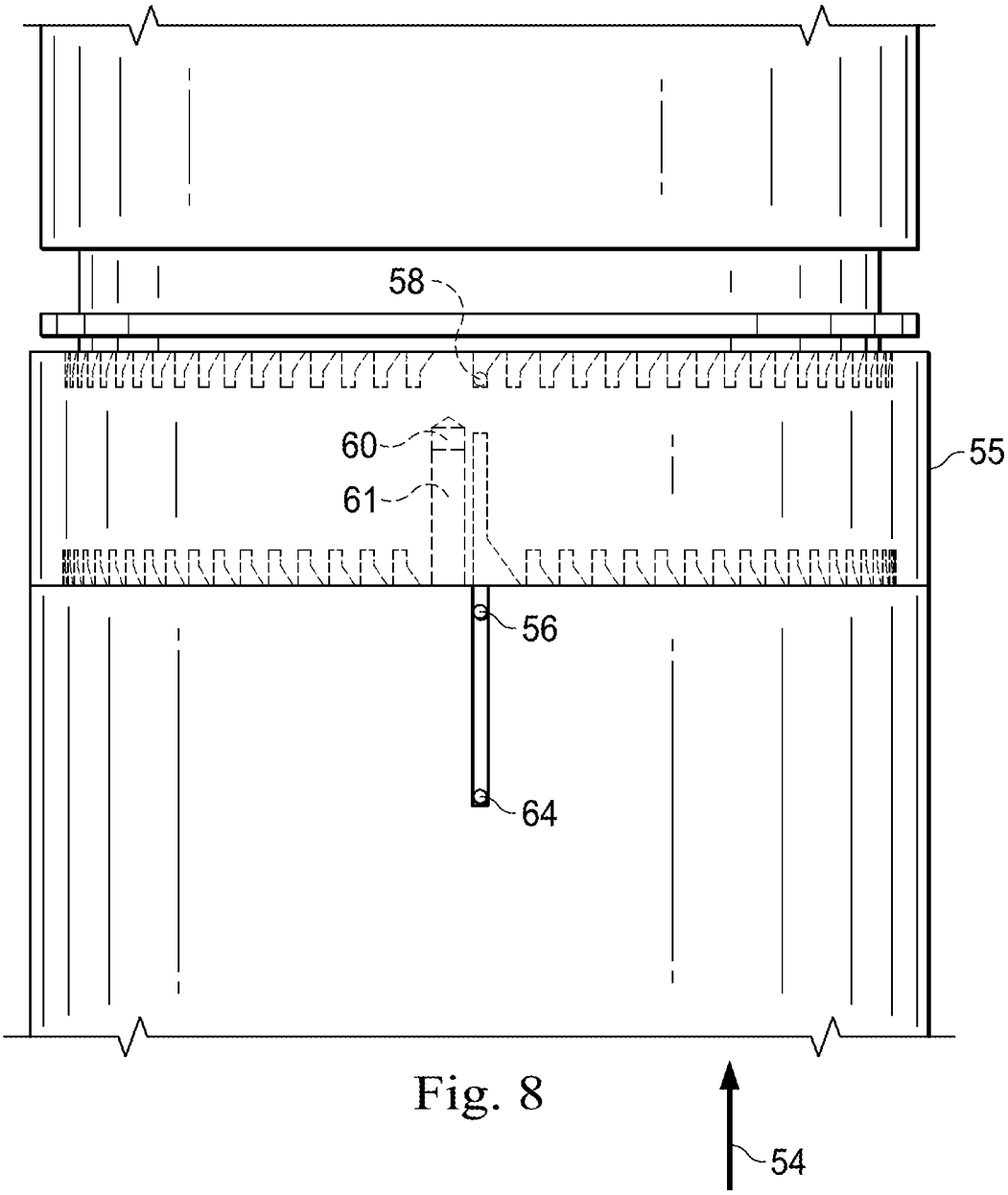
FIG. 8 illustrates a side view of the embodiment of a counting mechanism of the present invention illustrated in FIG. 5 with a locking ring in a locked position.
Figure 9:
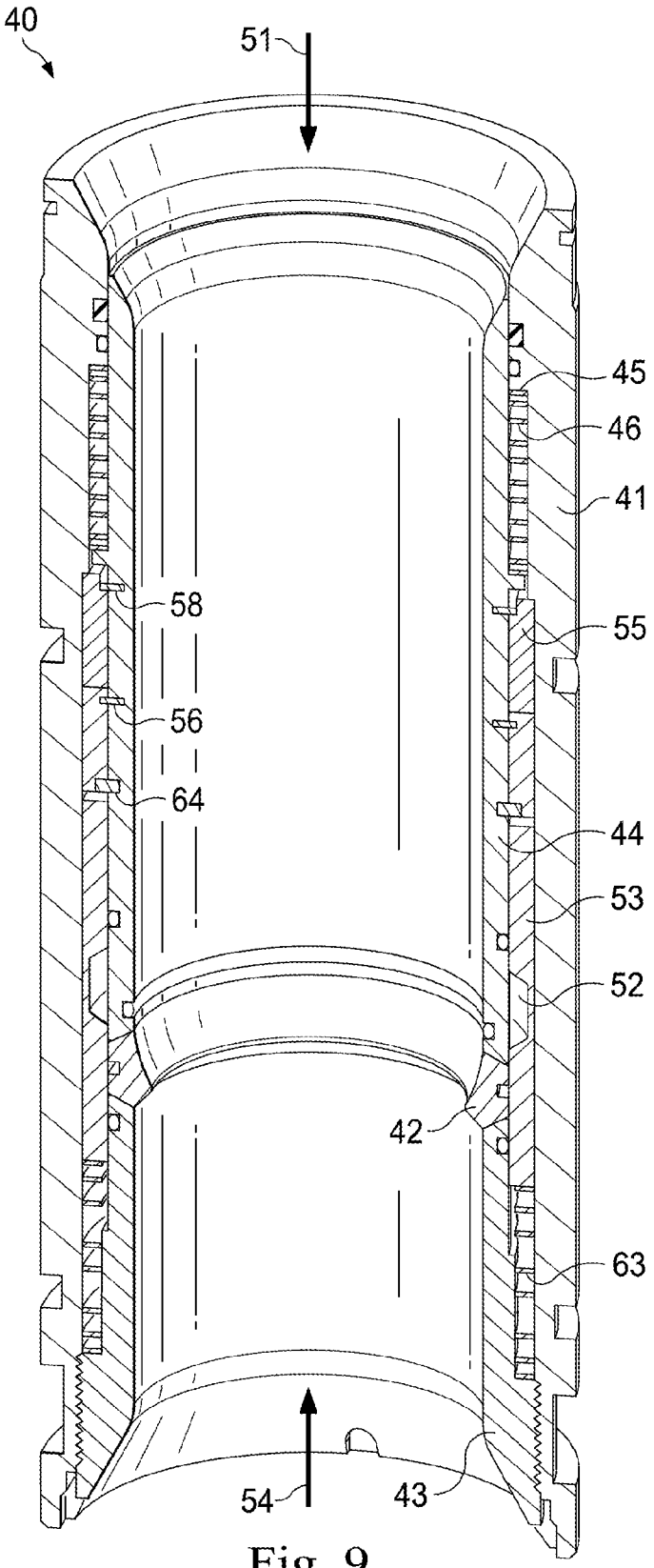
FIG. 9 illustrates a cross-section of the fracture plug seat assembly illustrated in FIG. 3 with a locking ring in a locked position.
Figure 10:
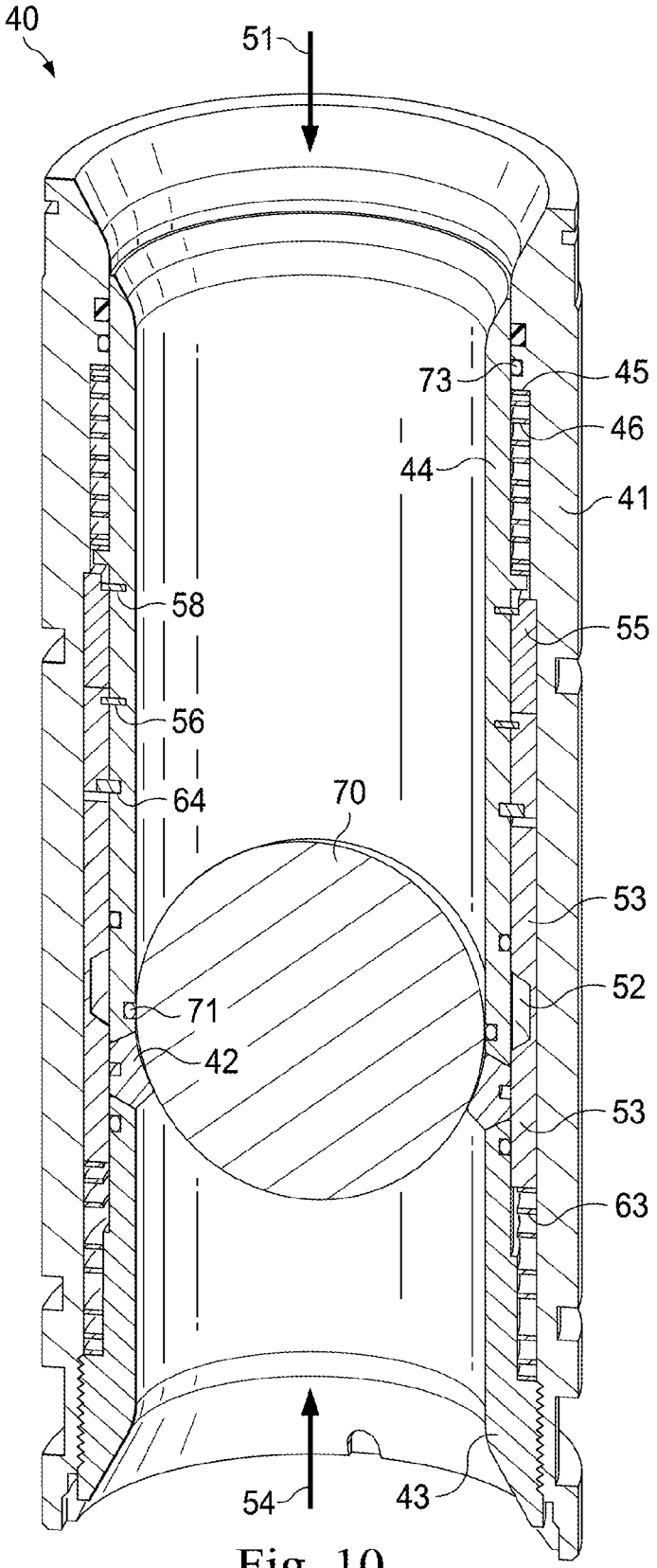
FIG. 10 illustrates a cross-section of the fracture plug seat assembly illustrated in FIG. 9 with a ball plugging the seat.

FIG. 6 illustrates an isometric view of the downstream side of counting ring 55. As depicted, counting ring 55 has two synchronized sets of cam surfaces 57, each set spanning nearly 180 degrees. Two holes 60 are located in the downstream face of the counting ring 55. As shown in FIG. 7, a partially translucent counting ring 55 is shown in a side view with a radial pin 56 engaging a cam surface 57. Also, as shown in FIG. 7, yet another radial pin 64 keeps the locking ring 53 from rotating relative to the upper piston 44. FIG. 7 is consistent with the position shown in FIG. 4. Further, as shown in FIG. 7, an axial pin 61 is fixed to the locking ring 53 and slides across the smooth surface 62 of counting ring 55 (FIG. 6). An additional axial pin is diametrically opposite the axial pin 61 and is fixed to the locking ring 53 and slides across the smooth surface 62 of counting ring 55. When a predetermined number of balls have passed through the seat assembly 42 and have thus rotated the counting ring 55 in relation to the locking ring 53, the pin(s) 61 engage hole(s) 60 and a spring 63 (FIG. 3) forces the locking ring 53 in the upstream direction 54, as shown in FIG. 8. FIG. 9 shows the sliding sleeve assembly 40 in the position where the locking ring 53 has shifted upstream and is in contact with the counting ring 55. The pocket 52 is no longer in a position to allow expansion of the expandable seat assembly 42 from a ball passing in the direction 51. FIG. 10 illustrates the sliding sleeve assembly 40 with a ball 70 that has landed on the expandable seat assembly 42 when the locking ring 53 is in the locked position. The expandable seat assembly 42 is restricted from expanding due to the locking ring 53 and hence the ball 70 cannot pass in the downstream direction 51. A seal 71 can assist in preventing fluid from passing by the ball 70 in the downstream direction 51 and a seal 73 prevents fluid from passing between the upper piston 44 and the sliding sleeve 41. Pressure applied to the ball in the downstream direction 51 results in the force necessary to actuate the sliding sleeve assembly 40 to an opened position so its corresponding zone can be fractured.

Figure 11:
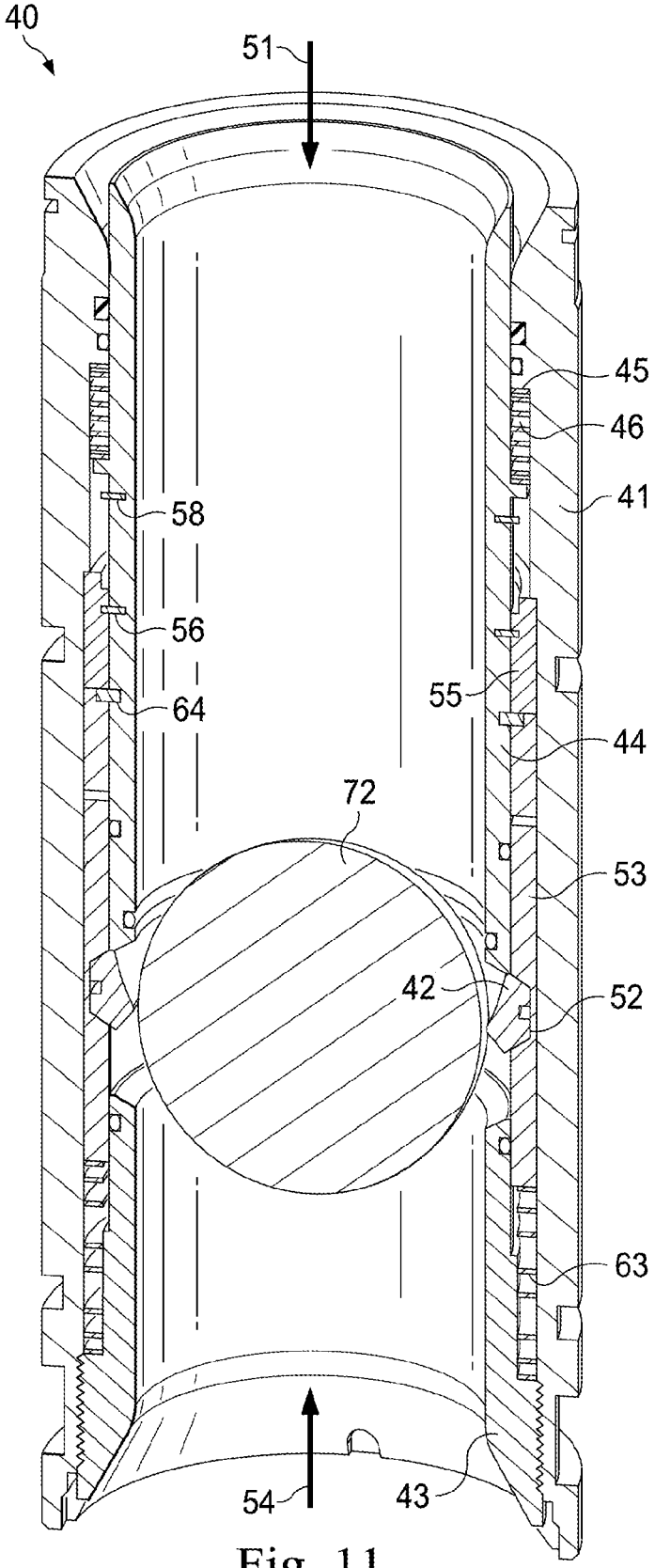
FIG. 11 illustrates a cross-section of the fracture plug seat assembly illustrated in FIG. 9 with a ball purging to the surface.

When pressure in the downstream direction is relieved, the ball 70 is purged to the surface in the direction 54 by accumulated pressure from downstream. FIG. 11 illustrates a ball 72 that had previous passed through the sliding sleeve assembly 40 in the downstream direction 51 and actuated the counting ring 55. Now pressure from the downstream side of the ball 72 forces the expandable seat assembly 42 to slide in the upstream direction 54 until it reaches the pocket 52. Ball 72 can now pass through the expandable seat assembly 40 and freely purge to the surface.

Figure 12:
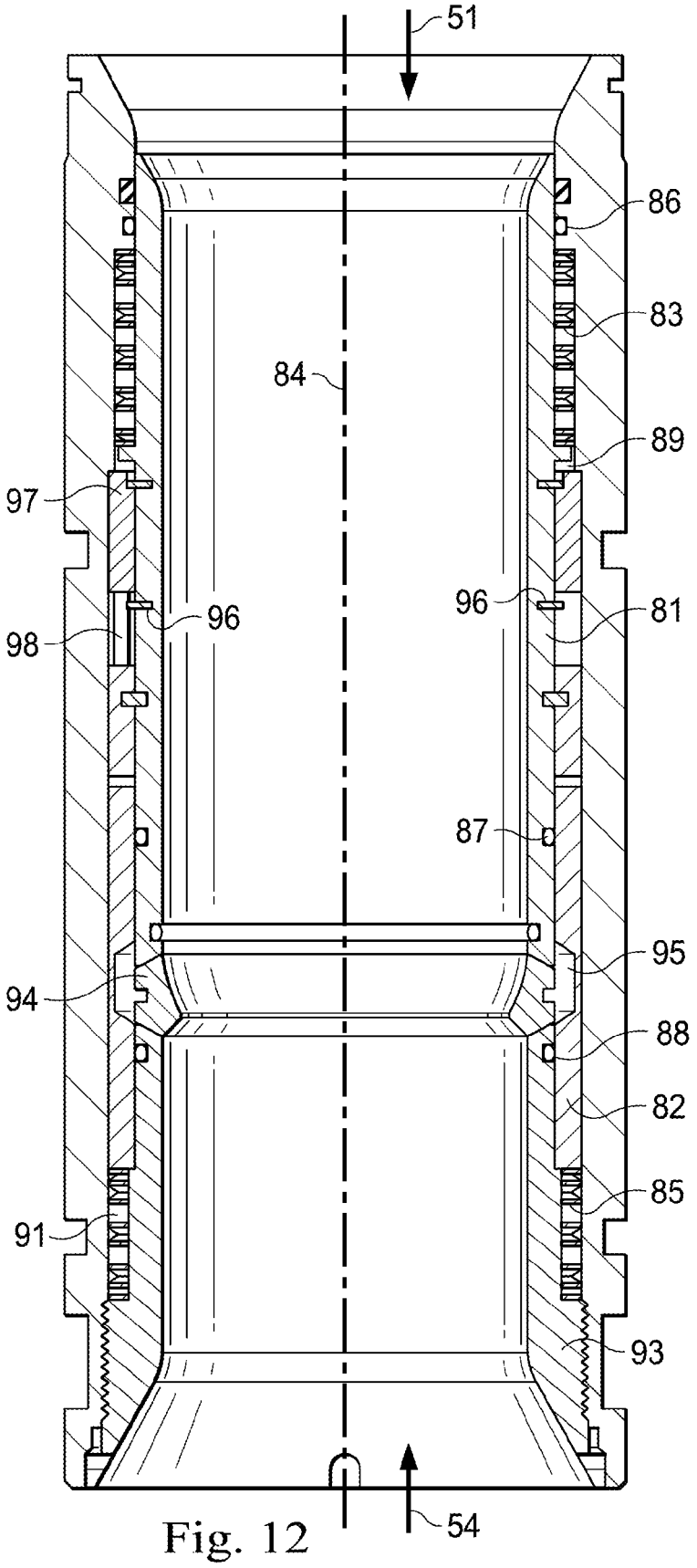
FIG. 12 is a cross-section of a fracture plug seat assembly of the present invention.

FIG. 12 is a cross-section of a fracture plug seat assembly of the present invention in a position ready to count a ball. As shown in FIG. 12, an upper wave spring 83 which helically spirals around axis 84, biases an upper piston 81 in the downstream direction 51. A wave spring 85 similar to the upper wave spring 83 biases a locking ring 82 in the upstream direction 54. An expandable seat assembly 94 is clamped by the biased upper piston 81 and a lower seat nut 93 into a cinched position. The expandable seat assembly 94 is free to expand into a pocket 95 when a ball passes through. When a ball actuates the expandable seat assembly 94, the upper piston 81 carries radial pins 96 into a cam profile of counting ring 97 to initiate rotation of the counting ring 97. After the final ball to be counted passes through the expandable seat assembly 94, an axial pin 98 falls into a mating hole in counting ring 97 and the locking ring 82 is free to be pushed in the upstream direction 54 by the wave spring 85.

Also illustrated in FIG. 12 are an upper wiper seal 86, a lower seal 87 and a nut seal 88. According to the embodiment shown in FIG. 12, both upper wiper seal 86 and lower seal 87 engage the upper piston 81 at the same diameter so there is no change in volume in annulus 89 when the upper piston 81 is actuated. While not essential to the function of this embodiment of the fracture plug seat assembly, this embodiment resists the accumulation of dirty fluid in the annulus 89. Also, the nut seal 88 guards against the incursion of debris into the space 91. Expandable seat assembly 94 may be formed from any suitable material such as a segmented ring of drillable cast iron. Those of ordinary skill in the art will understand that the expandable seat assembly 94 may also be encapsulated in rubber so as to guard against the entry of contaminants into pocket 95 and to shield the cast iron from the abrasive fluid passing through the expandable seat assembly 94.

It is to be understood that the means to actuate the counter could be a lever or radial piston that is not integrated into the expandable seat. It is convenient to use the expandable seat as the mechanism to actuate the counter. It is also to be understood that the counter could actuate a collapsible seat.

It is understood that variations may be made in the foregoing without departing from the scope of the disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, any means-plus-function clauses are intended to cover the structures described herein as performing the recited function and not only structural equivalents, but also equivalent structures.

The invention claimed is:

1. Control apparatus operably positionable in a wellbore, comprising:

a tubular member extending along an axis;

an annular seat structure coaxially supported within said tubular member and being diametrically expandable, said annular seat structure having an annular, conically tapered side surface and being coaxially sandwiched between and contacted by a first annular surface of a first cylindrical structure and a second annular surface of a second cylindrical structure, one of said first and second annular surfaces being slidingly and complementarily engaged with said annular, conically tapered side surface of said annular seat structure; and a spring structure forcing said one of said first and second annular surfaces against said annular, conically tapered side surface of said annular seat structure in a manner urging said annular seat structure toward a diametrically contracted orientation, the spring structure also forcing said annular seat structure against the other of the first and second annular surfaces.

2. The control apparatus of claim 1 wherein:

said annular seat structure has a second annular, conically tapered side surface opposite from said first-mentioned annular, conically tapered side surface, and the other one of said first and second annular surfaces slidingly and complementarily engages said second annular, conically tapered side surface of said annular seat structure.

3. The control apparatus of claim 2 wherein:

said first and second annular surfaces are conically configured and are radially outwardly tapered in axially opposite directions.

4. The control apparatus of claim 1, wherein the annular seat structure is diametrically expandable, by a plug member passing axially therethrough, from said diametrically contracted orientation to a diametrically expanded orientation, said diametrically contracted orientation being small enough to block passage of the plug member through said annular seat structure and said diametrically expanded orientation permitting the plug member to pass through said annular seat structure, the control apparatus comprising:

a counter apparatus operative to lock said annular seat structure at said diametrically contracted orientation in response to a predetermined number of plug members having passed through and diametrically expanded said annular seat structure to said diametrically expanded orientation.

5. The control apparatus of claim 4, wherein said counter apparatus includes:

a first portion rotationally indexable about said axis, and a second portion comprising said first annular surface, said first annular surface slidably engaging the conically tapered side surface of said annular seat structure, the second portion being (1) axially shiftable by said conically tapered side surface during diametrical expansion of said annular seat structure by a plug member passing therethrough, and (2) operative, in response to being axially shifted, to engage said first portion and rotationally index it through a predetermined angle about said axis.

6. The control apparatus of claim 1 wherein:

said annular seat structure is resiliently expandable from a first diameter to a second diameter.

7. The control apparatus of claim 6 wherein:

said annular seat structure is of a circumferentially segmented construction.

8. The control apparatus of claim 7 wherein:

said annular seat structure includes a series of rigid circumferential segments carrying a single elastomeric material resiliently biasing said annular seat structure radially inwardly toward said first diameter thereof.

9. The control apparatus of claim 8 wherein:

said rigid circumferential segments are encapsulated in said elastomeric material.

10. The control apparatus of claim 9 wherein:

said rigid circumferential segments are metal, and said elastomeric material is a rubber material.

11. The control apparatus of claim 1, wherein the wellbore has an upstream end closer to a ground surface and a downstream end closer to an end of the wellbore, and wherein the spring structure is disposed upstream of the annular seat structure.

12. A fracture plug seat assembly comprising the control apparatus of claim 1.

13. A sliding sleeve valve comprising the control apparatus of claim 1.

14. Control apparatus operably positionable in a wellbore, comprising:

a tubular member extending along an axis;

an annular seat structure coaxially supported within said tubular member and being diametrically expandable, said annular seat structure having an annular, conically tapered side surface and being coaxially sandwiched between and contacted by a first annular surface of a first cylindrical structure and a second annular surface of a second cylindrical structure, one of said first and second annular surfaces being slidingly and complementarily engaged with said annular, conically tapered side surface of said annular seat structure; and a spring structure forcing said one of said first and second annular surfaces against said annular, conically tapered side surface of said annular seat structure in a manner urging said annular seat structure toward a diametrically contracted orientation, wherein the wellbore has an upstream end closer to a ground surface and a downstream end closer to an end of the wellbore, and wherein said first annular surface is in contact with the conically tapered side surface of the annular seat structure, wherein the first cylindrical structure is disposed upstream of the annular seat structure and is axially displaceable along the axis when the tapered side surface of the annular seat structure expands towards a second diametrically expanded orientation and slides along said first annular surface.

15. The control apparatus of claim 14, comprising:

a second cylindrical structure comprising said second annular surface in contact with the annular seat structure, said second cylindrical structure being disposed downstream of the annular seat structure, said second annular surface being an annular tapered portion in contact with the annular seat structure and arranged such that when the annular seat structure diametrically expands, the annular seat structure slides along the annular tapered portion of the second cylindrical structure and axially displaces in an upstream direction.

16. Control apparatus operably positionable in a wellbore, comprising:

a tubular member extending along an axis;

an annular seat structure coaxially supported within said tubular member and being diametrically expandable, by a plug member passing axially therethrough, from a first diameter small enough to block passage of the plug member through said annular seat structure to a second diameter permitting the plug member to pass through said annular seat structure, and then being contractible to said first diameter;

a first cylindrical structure axially displaceable along the axis within the tubular member and having an annular tapered portion in contact with the annular seat structure, the first cylindrical structure being axially displaceable relative to the tubular member along the axis when the annular seat structure expands towards the second diameter and slides along the annular tapered portion; and a spring element upstream of the first cylindrical structure and applying a biasing force to maintain the first cylindrical structure in a downstream position.

17. The control apparatus of claim 16, wherein the annular seat structure comprises an annular conical portion in slidable contact with the tapered portion of the first cylindrical structure.

18. The control apparatus of claim 16, wherein the wellbore has an upstream end closer to the earth surface and a downstream end closer to an end of the wellbore, and wherein the first cylindrical structure is disposed upstream of the annular seat structure.

19. The control apparatus of claim 16, comprising a second cylindrical structure slidably engaging a peripheral area of said annular seat structure opposite the first cylindrical structure, said second cylindrical structure comprising a second annular tapered portion in contact with the annular seat structure and arranged such that when the annular seat structure diametrically expands, the annular seat structure slides along the second annular tapered portion of the second cylindrical structure and axially displaces in an upstream direction.

20. The control apparatus of claim 16, further comprising a counter apparatus operative to lock said annular seat structure at said first diameter in response to a predetermined number of plug members having passed through and diametrically expanded said annular seat structure to said second diameter, said counter apparatus including:

a first portion rotationally indexable about said axis, and wherein the first cylindrical structure comprises said first annular surface in contact with the annular seat structure, the second portion being (1) axially shiftable by said conically tapered side surface during diametrical expansion of said annular seat structure by a plug member passing therethrough, and (2) operative, in response to being axially shifted, to engage said first portion and rotationally index it through a predetermined angle about said axis.

21. Control apparatus operably positionable in a wellbore, comprising:

a tubular member extending along an axis;

an annular seat structure coaxially supported within said tubular member and being diametrically expandable, said annular seat structure having an annular, conically tapered side surface;

a first cylindrical portion disposed upstream of the annular seat structure and having a first annular surface in sliding engagement with the conically tapered side surface of the annular seat structure;

a second cylindrical portion disposed downstream of the annular seat structure and having a second annular surface in sliding engagement with the annular seat structure, the first and second annular surfaces engaging opposing sides of the annular seat structure;

a spring structure acting on said first cylindrical portion to force said first annular surface against said annular, conically tapered side surface of said annular seat structure in a manner urging said annular seat structure toward a diametrically contracted orientation, said spring structure applying force on the annular seat structure to force said annular seat against said second annular surface.

22. The control apparatus of claim 21, wherein the annular seat structure is arranged to axially displace one of the first and second cylindrical portions and compress the spring when the annular seat structure diametrically expands.

23. The control apparatus of claim 21, further comprising:

an indexable portion cooperatively engaged with one of the first and second cylindrical portions, the indexible portion being rotationally indexable about said axis in response to axial displacement of one of the first and second cylindrical portions during diametrical expansion of said annular seat structure.

24. The control apparatus of claim 21, wherein the wellbore has an upstream end closer to a ground surface and a downstream end closer to an end of the wellbore, and wherein the spring structure is disposed upstream of the annular seat structure.

* * * * *